United States Patent [19]

Czosnyka et al.

[11] 4,238,118

[45] Dec. 9, 1980

[54] METHOD OF PERMANENT PROTECTION OF THE LOWER PART OF THE BLAST FURNACE, IN PARTICULAR OF THE BOTTOM OF THE BLAST FURNACE HEARTH

[75] Inventors: Stanisław Czosnyka; Walter Krzywon; Andrzej Kozien; Stanisław Cichocki; Ryszard Benesch, all of Craców, Poland

[73] Assignee: Osrodek Badawgzo-Rozwojowy Przemyslu Budowy Urzadzen Chemicznych "CEBEA", Craców, Poland

[21] Appl. No.: 17,211

[22] Filed: Mar. 5, 1979

[30] Foreign Application Priority Data

Mar. 8, 1978 [PL] Poland ..... 205234

[51] Int. Cl.[3] ..... C21B 7/10

[52] U.S. Cl. ..... 266/46; 75/41

[58] Field of Search ..... 75/41; 266/46, 44

[56] References Cited

U.S. PATENT DOCUMENTS 2,805,851 9/1957 Becker et al. ..... 266/46

*Primary Examiner*—R. Dean

*Attorney, Agent, or Firm*—Ladas & Parry

[57] ABSTRACT

The hearth's bottom of the blast furnace is protected according to the invention shielded said bottom by means of the so-called skull, e.g. a layer of coagulated metal intentionally formed and kept by means of controlled withdrawal of heat by means of a heat exchanger situated in the vicinity of protected surfaces. The exchanger constitutes a component of a known cooling system.

2 Claims, No Drawings

METHOD OF PERMANENT PROTECTION OF THE LOWER PART OF THE BLAST FURNACE, IN PARTICULAR OF THE BOTTOM OF THE BLAST FURNACE HEARTH

The method of permanent protection of the lower part of the blast furnace, in paticular of the bottom of the blast furnace hearth.

The subject of the invention is the method of permanent protection of the lower part of the blast furnace, in particular of the bottom of the blast furnace hearth, against erosive and chemical action of liquid pig-iron.

Blast furnaces in ferrous metallurgy are operated continuously and their periodical standstills result from the necessity of carrying out repairs of the inwall and the lining of the blast furnace, since these repairs cannot be carried out during the operation of the blast furnace.

As it results from many years' observations of operation of blast furnaces, overhaul life depends on the degree of wear of internal surfaces of the blast furnace, the bottom the the hearth being most liable to suffer from destructive action of molten metal at a temperature which exceeds considerably its melting point.

The internal surface of the hearth is usually made of precisely fitted blocks of enriched carbon which is a material of high chemical and thermal resistance. Nevertheless, it is impossible to protect the carbon inwall against dissolving in liquid pig-iron/by diffusion/, when carbon content in pig-iron is smaller than the saturation state. The phenomenon of dissolution of carbon in pig-iron is accompanied by erosive action of liquid pig-iron which is in constant motion. The said erosive action causes that once the damaging process of the lining is started it develops very fast. This is favoured by a considerable difference between specific gravities of the lining and pig-iron, the said difference causing loosened blocks detach from their foundation under the effect of the uplift force and flow out to the surface of the molten contents of the hearth.

The life of the hearth bottom has been hitherto prolonged by means of enlarging its laminar structure up to such thickness which—for the period of the planned operation of the blast furnace—would provide for its wear to at least the critical value dictated by safety reasons. The said structure is composed of carbon blocks and graphite boards, the carbon blocks constituting the layer which contacts liquid pig-iron. The number and thickness of the said layers are varied and depend on the quality of the applied material, the size of the blast furnace and the cooling facilities. The aforesaid method of prolonging the life of the hearth bottom, in spite of the fact that it is material- and labour-consuming, does not solve the problem of hearth bottom durability sufficiently.

In the blast furnaces presently used, according to cooling conditions, layers of coagulated metal can be formed in the lower part of the hearth, and due to this a reduced wear of the hearth lining is observed. However, fortuitousness of formation of the said layer should not be considered a phenomenon whose role in the operation process of the blast furnace is explicitly determined. Formation of the said layer, commonly determined as skull, has been recognized as an uncontrollable phenomenon. In spite of various solutions being applied, both with regard to lining material and to the number of materials, progressive wear of lining layers has been always observed, mainly of the hearth bottom, and therefore these symptoms are considered a necessary evil.

The object of the invention is to determine a method of permanent protection of the lower part of the hearth, in particular of the bottom, against wear resulting from erosive and chemical action of liquid pig-iron.

According to the invention this aim has been achieved due to the fact that the lining subjected to damage is shielded with a layer of coagulated metal, the so-called skull, whose predetermined required thickness is obtained and maintained by means of controlled heat withdrawal from the layer of the lining which is situated around the lower part of the hearth, below the iron notches. The skull thus formed constitutes a shell which sufficiently protects the bottom of the hearth. Controlled heat withdrawal from the lining layer situated around the lower part of the hearth, below the iron notches, is carried out by means of a heat exchanger located in the vicinity of the protected surfaces, the said exchanger constituting a component of the cooling system.

EXAMPLE 1

In order to achieve permanent protection of the hearth bottom of the blast furnace it has been assumed that the thickness of a skull layer is 0.3 m and its limiting temperature is 1145° C./2093° F./. It has been calculated, for an exemplary furnace, that it is necessary to abstract a heat quantity of approximately 1 Gcal/h. To this aim an appropriately selected/with regard to output/cooling system has been used, consisting of a compressor, a condenser, and an evaporator, the latter being located in the lining of the hearth bottom of the blast furnace, in parallel to the protected surface. In such a system for direct withdrawal of heat a coolant which is $NH_3$ or R12 is compressed in a compressor, then it passes through a condenser and, after expansion, enters an evaporator where it is evaporated at the expense of heat absorbed from the lining. Vapours of the coolant which leave the evaporator are sucked in by the compressor and are compressed again. A constant temperature of the lining is maintained automatically by means of controlling the rate of flow of the coolant through the evaporator according to pulses transmitted by temperature detectors installed in the lining layer between the evaporator and the surface of the hearth bottom.

EXAMPLE 2

A cooling system consisting of a compressor, a condenser, and an evaporator, abstracts heat from brine circulating in closed cycle stimulated by a circulating pump and composed of two heat exchangers, one of them being installed in the lining layer of the hearth bottom of the blast furnace, the other being located outside the blast furnace, in the evaporator of the above mentioned cooling system. This system for indirect withdrawal of heat enables applying of practically any liquid heat carrier, depending on the requirements dictated by operation conditions, the type of lining, or the material of which the exchanger is made.

The method according to the invention renders it possible to design blast furnaces with hearths of practically unchanging internal contours. This, in consequence, creates a possibility of considerable design changes of the lower part of the blast furnace, i.e. of the hearth and the hearth block. Due to the method according to the invention the lower part of the blast furnace can be made of materials whose quality does not need to be necessarily high and whose quantity is considerably lower than hitherto. A further advantage of application of the invention is prolongation of overhaul life of the blast furnace, due to elimination of possible damages of the hearth and the hearth block. This fact contributes directly to shortening of the repair period as well as the time necessary for repairs of the hearth block of the blast furnace, the said time having amounted hitherto to 35% of the general time of major repair of the blast furnace.

What is claimed is:

1. A method of permanent protection of the lower part of the blast furnace, in particular of the hearth bottom, against corrosive and chemical action of liquid pig-iron, comprising the steps of: forming directly upon the surface of the bottom lining a permanent protective layer of coagulated metal and slag, as a shield for the lining, the said layer having a predetermined required thickness; and maintaining said protective layer by controlled withdrawal of heat from the layer of the lining encircling the lower part of the hearth, below the part containing the molten iron.

2. A method according to claim 1, wherein the step of controlled withdrawal of heat from the lining layer encircling the lower part of the hearth below the molten iron is carried out by circulating a cooling medium through a heat exchanger situated in the vicinity of the protected surfaces, the said heat exchanger including an evaporator located in the furnace lining adjacent and parallel to the protected surface.

* * * * *